US008584362B2

(12) United States Patent
Mezera et al.

(10) Patent No.: US 8,584,362 B2
(45) Date of Patent: Nov. 19, 2013

(54) THREE PIECE LIFT ARM APPARATUS AND METHOD

(75) Inventors: Richard Mezera, Elk Run Heights, IA (US); Kevin Watje, Cedar Falls, IA (US); Doug Halbur, Glidden, IA (US); Dean Steege, Cedar Falls, IA (US)

(73) Assignee: Wayne Industrial Holdings, LLC, Cedar Falls, IA (US)

( * ) Notice: Subject to any disclaimer, the term of this patent is extended or adjusted under 35 U.S.C. 154(b) by 1319 days.

(21) Appl. No.: 12/266,316

(22) Filed: Nov. 6, 2008

(65) Prior Publication Data

US 2010/0111656 A1 May 6, 2010

(51) Int. Cl.
*B21D 53/88* (2006.01)

(52) U.S. Cl.
USPC ..... 29/897.2; 403/270; 414/772

(58) Field of Classification Search
USPC ..... 228/101; 403/265–267, 270–272; 29/897.2; 414/407, 408, 722
See application file for complete search history.

(56) References Cited

U.S. PATENT DOCUMENTS

| | | | | | |
|---|---|---|---|---|---|
| 2,136,122 | A | * | 11/1938 | Almdale | 280/797 |
| 2,808,161 | A | | 10/1957 | Gentile | |
| 3,078,000 | A | | 2/1963 | Dempster et al. | |
| 3,112,834 | A | | 12/1963 | Dempster et al. | |
| 3,122,250 | A | | 2/1964 | French et al. | |
| 3,130,845 | A | | 4/1964 | French et al. | |
| 3,130,846 | A | | 4/1964 | Wender | |
| 3,195,748 | A | | 7/1965 | Dempster et al. | |
| 3,202,305 | A | | 8/1965 | Dempster et al. | |
| 3,254,780 | A | | 6/1966 | Midtbo | |
| 3,474,923 | A | | 10/1969 | Anderson | |
| 3,628,300 | A | * | 12/1971 | Tsurumi | 52/848 |
| 3,661,285 | A | * | 5/1972 | Appleman | 414/408 |
| 4,085,858 | A | | 4/1978 | Smith | |
| 4,091,944 | A | | 5/1978 | Gollnick | |
| 4,547,118 | A | * | 10/1985 | Pittenger | 414/408 |
| 4,647,267 | A | * | 3/1987 | Hund, Jr. | 414/408 |
| 5,611,657 | A | * | 3/1997 | Peterson | 414/722 |
| 5,658,117 | A | * | 8/1997 | McKinney et al. | 414/408 |
| 5,690,465 | A | | 11/1997 | Ledwell | |
| 5,984,609 | A | | 11/1999 | Bartlett | |
| 6,059,482 | A | * | 5/2000 | Beauvoir | 403/262 |
| 6,733,040 | B1 | * | 5/2004 | Simboli | 280/800 |
| 7,354,238 | B2 | * | 4/2008 | Fukudome et al. | 414/686 |
| 7,442,001 | B2 | * | 10/2008 | Higashikawa et al. | 414/722 |

(Continued)

OTHER PUBLICATIONS

Feb. 10, 2010 European Search Report (App. No. 09013889.2-1261).

*Primary Examiner* — Joshua Rudawitz
(74) *Attorney, Agent, or Firm* — Husch Blackwell LLP

(57) ABSTRACT

The present invention is a refuse truck lift arm with sections that are bolted, not welded, together. Where the sections are joined together there is a recess and key arrangement. The key is seated in the recess of each half and straddles the inner face that divides them. In this way, shear forces that would otherwise be entirely borne by the bolts are also placed on the key. Each of the three sections, called "weldments," are welded together in a novel way. The welding placement and sequence reduces welding distortion. Two C-shaped steel pieces are used for each straight section of each weldment. First, interior reinforcing brackets are welded into each C-section. Next, the two C-shaped sections are welded together, with the weld being between the edges that will form the thin side of the arm.

1 Claim, 7 Drawing Sheets

(56) References Cited

U.S. PATENT DOCUMENTS 7,448,841 B2 * 11/2008 Ishikawa et al. ..... 414/722
7,761,973 B2 * 7/2010 Toback ..... 29/525.13
7,784,186 B2 * 8/2010 White et al. ..... 29/897.2
8,096,583 B2 * 1/2012 Maiorana et al. ..... 280/789
2010/0158653 A1 * 6/2010 Webb et al. ..... 414/722
2010/0320792 A1 * 12/2010 Murray et al. ..... 296/26.09

* cited by examiner

THREE PIECE LIFT ARM APPARATUS AND METHOD

CROSS-REFERENCE TO RELATED APPLICATIONS

None

STATEMENT REGARDING FEDERALLY SPONSORED RESEARCH

Not Applicable.

APPENDIX

Not Applicable.

BACKGROUND OF THE INVENTION

1. Field of the Invention

The present invention is in the field of refuse truck lift arm fabrication and shipping thereof.

2. Related Art

The refuse industry has always used welding to assemble the lift arms on refuse trucks so that they are strong enough to lift dumpsters and the like. Traditionally, these arms were constructed of four flat pieces of steel whose edges were welded together to form the corners of a box; that is, a long arm piece with a rectangular cross section. The long pieces were then welded together, usually at an angle, to produce the familiar overhead lift arms. Because welding tends to distort the metal being welded, it has often been difficult to produce arms that are aligned properly.

Refuse truck lift arms typically have two, three or more long sections that are not parallel. Shipping these arms has required large, expensive packaging.

SUMMARY OF THE INVENTION

The present invention is a refuse truck lift arm with sections that are bolted, not welded, together. Where the sections are joined together there is a recess and key arrangement. The key is seated in the recess of each half and straddles the interface that divides them, adding strength.

Each of the three sections, called "weldments," are welded together in a novel way. The welding placement and sequence reduces welding distortion. In the present invention, two C-shaped steel pieces are used for each straight section of each weldment. First, interior reinforcing brackets are welded into each C-section. Next, the two C-shaped sections are welded together, with the weld being between the edges that will form the thin side of the arm. These welds can be done sequentially or simultaneously. Finally, the curved corner sections are welded in to create the final weldment assembly. This way, welding distortion is reduced.

Because the lift arm is bolted together, there are fewer welds to distort it. The manner of welding also minimizes distortion. Also, because assembly can be done without welding, the lift arms may be shipped in compact weldment sections. The end result is a product that is far more easily shipped, has fewer welding distortions and has adequate strength.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
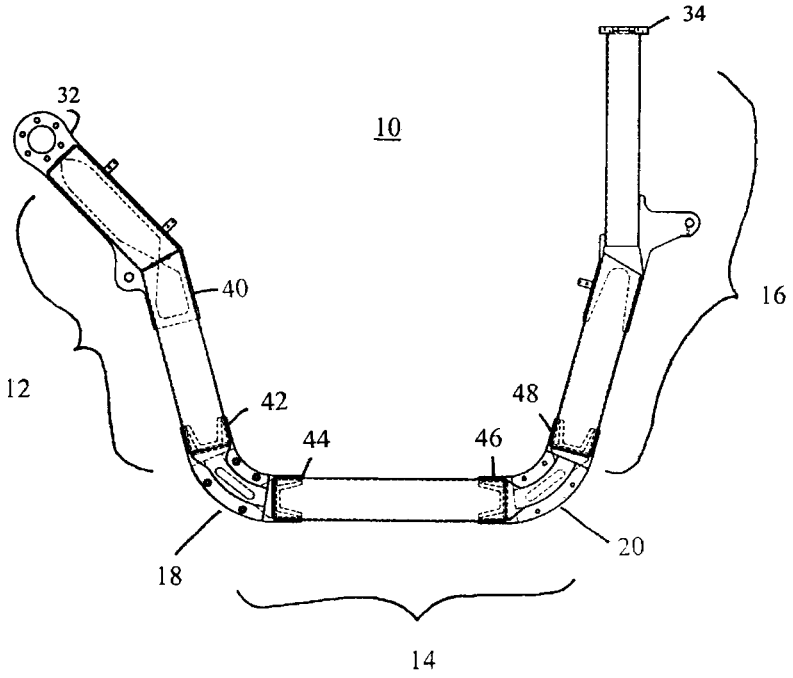
FIG. 1 is a side view of the loading arm of the present invention, assembled.
Figure 2:
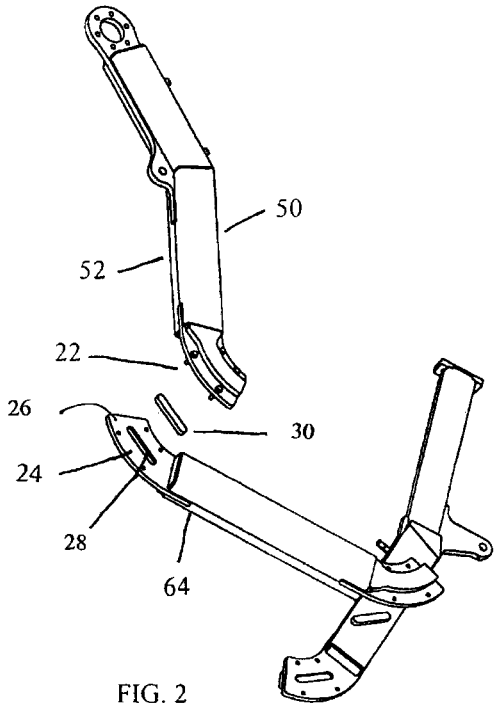
FIG. 2 is an exploded view of the lifting arm of the present invention showing separate weldments.
Figure 3:
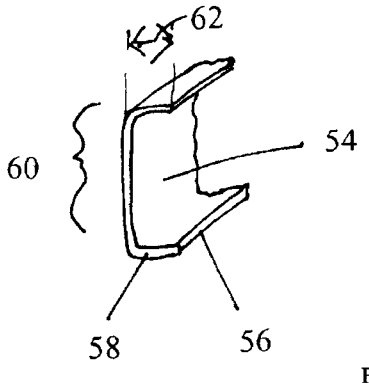
FIG. 3 is a close up of a weldment end.
Figure 4:
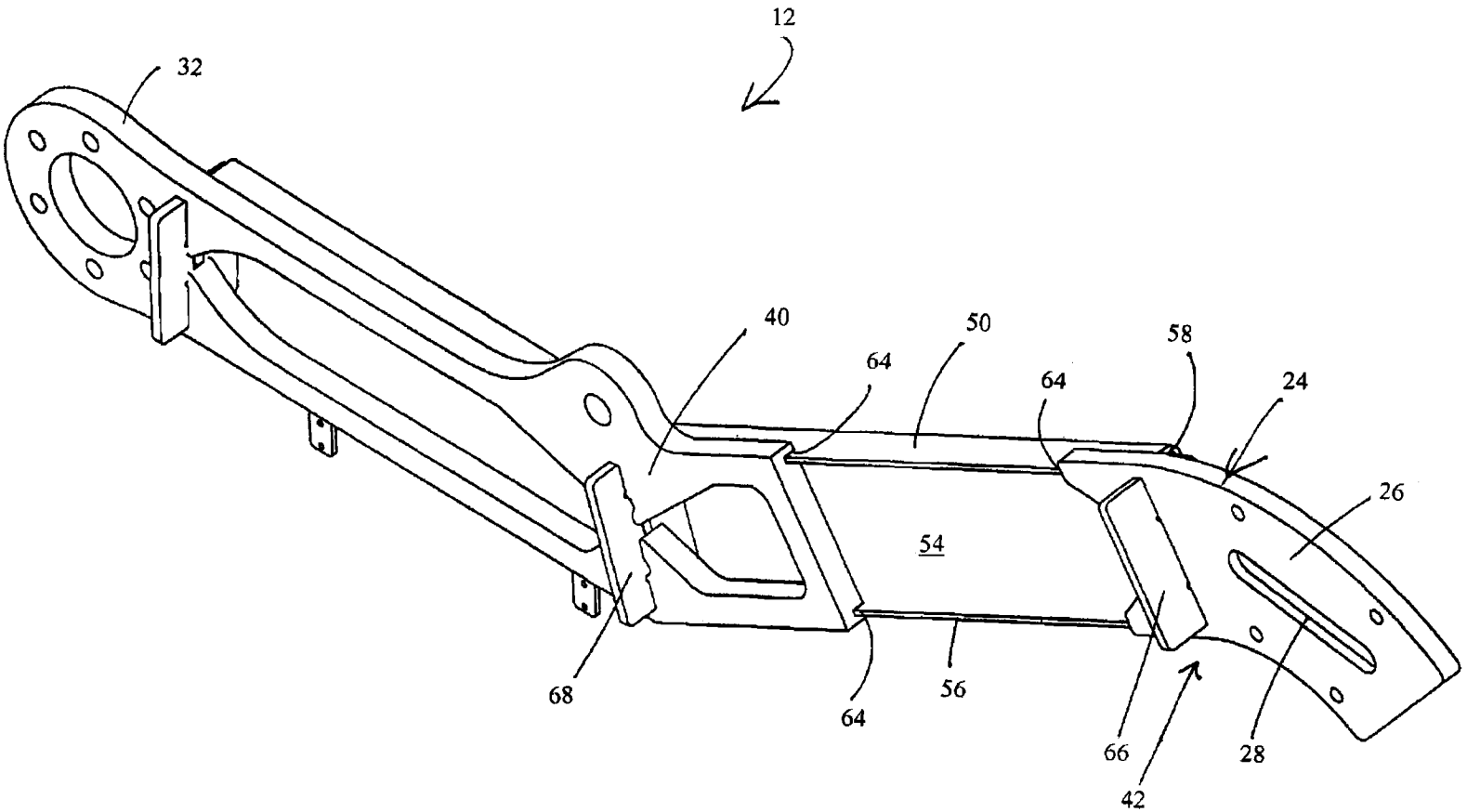
FIG. 4 is an isometric view of a partially assembled weldment.

The following description of the preferred embodiment(s) is merely exemplary in nature and is in no way intended to limit the invention, its application, or uses.

Referring now to the drawings wherein like reference numbers correspond to like elements, lifting arm 10 is comprised of three separate weldments, a proximate weldment 12, an intermediate weldment 14 and a distal weldment 16.

A joint 18 between the proximate weldment 12 and intermediate weldment 14 and a joint 20 between the intermediate weldment 14 and the distal weldment 16 are bolted, not welded together. Bolts and bolt holes 22 are used to assemble the weldments together into a completed lifting arm 10. Each joint, 18 and 20, is comprised of two plates 24. Each plate has an inner face 26 in which there is a recess 28. A corresponding inner face of a mating joint section from the other weldment being attached also has a recess. The recesses are dimensioned to seat a key 30. The depth of each recess 28 added together corresponds to the thickness of the key 30.

In assembly, the key 30 is placed in one of the two recesses 28, the other weldment is placed such that the bolt holes 22 and key 30 on the matching inner faces 26 are joined. The key 30 is thereby captured between the two. The key 30, overlaps the contact plane between the two inner faces 26 and provides a mass to receive and resist shear forces in order that they not be received and borne by the bolts alone. In this way, the joints 18, 20 are strengthened.

A proximate weldment 12 includes a mounting end 32 for attachment to a truck. A distal end 16 includes a mounting element 34 on which the forks may be attached to engage refuse containers, dumpsters and the like.

Within each of the weldments are reinforcing buttresses 40, 42, 44, 46, 48 and 50, indicated by the broken lines in FIG. 1. These are internal structures whose presence strengthens the overall lifting arm. They may be integral with the joint members 24, or end members 32, 34.

Each weldment is comprised of a left hand and right hand C-shaped member 50, 52. Each C-shaped member has an inner face 54, an inward facing edge 56 and an end edge 58. In assembly, interior buttresses 40-50 are welded to the inner face 54 of one of two complimentary left handed or right handed C-shaped members 50, 52. Some buttresses are integrally formed with joint members for example buttress/joint plate 42 in the depicted embodiment. Alternatively, they may be separate parts. Thereafter, left and right hand C-shaped members are joined such that their inner edges 56 abut, thereby encapsulating the buttresses 40-50 between them. The edges 56 are then welded together. For some weldments, an end piece, for example a joint member 18 or 20 would then be welded to the end edge 58 of the C-shaped section. An end cap 66 may be added. An interior transverse buttress 68 may also be added. Welding according to this method advantageously minimizes asymmetrical welding distortion.

Each C-shaped section has a width 60 and a thickness 62. In the depicted embodiment, the welds run along the thickness, 62, not the width 60, of the weldment. The end portions of each C-section may further include a slot 64. The slot may receive joint members 26.

Figure 5:
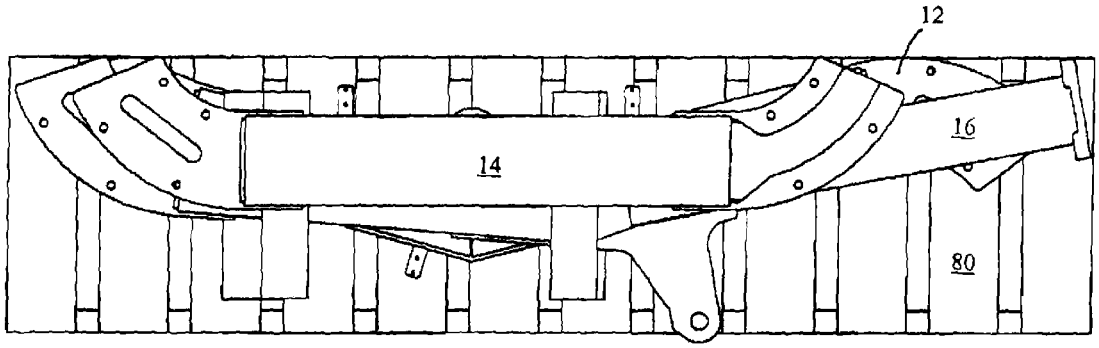
FIG. 5 is a top view of a shipping configuration.
Figure 6:
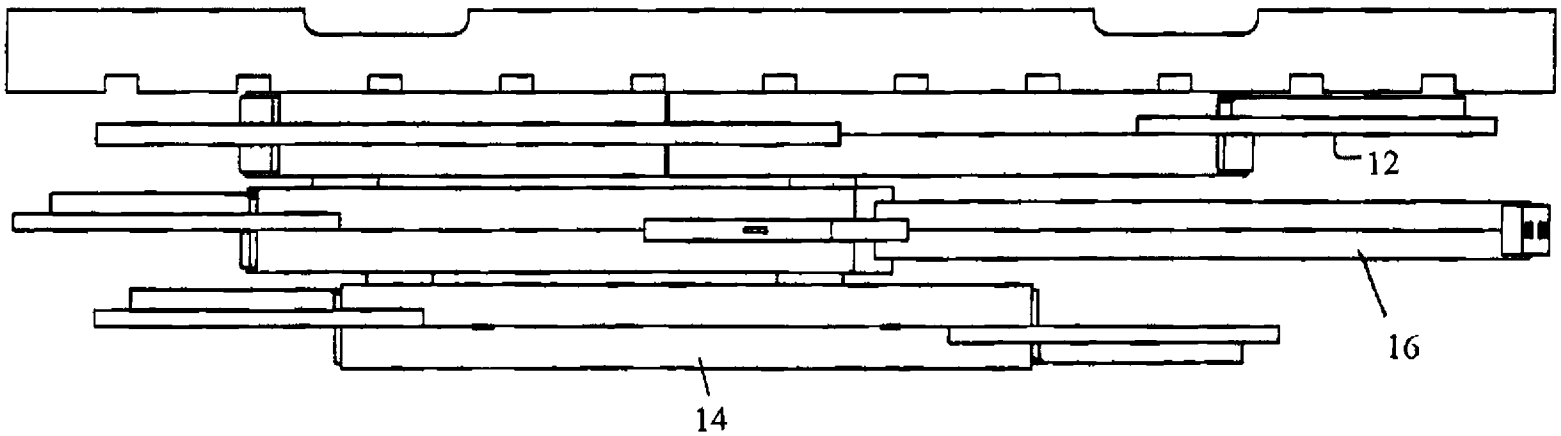
FIG. 6 is a side view of a shipping configuration.
Figure 7:
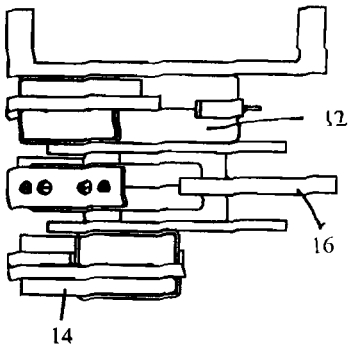
FIG. 7 is an end view of a shipping configuration.

The present invention may also facilitate speed and economy of shipping. Refuse truck lift arms are typically fabricated at a separate facility from the assembly of the truck. Refuse truck lift arms are also typically not straight, which means that a very large crate or other package is necessary for shipping them. According to the method of the present invention, each straight segment of a refuse truck lift arm may be fabricated separately. The straight weldment sections have assembly joints that do not require welding the straight weldment sections together. The final lift arm may therefore be assembled at the refuse truck assembly facility. Accordingly, two, three or more short, straight segments may be stacked, unassembled, in a substantially smaller volume package, allowing them to be shipped more economically. As best depicted in FIGS. 5, 6 and 7, the three separate weldments 12, 14 and 16 may be packaged in a compact container 80. Upon receipt of the shipped components, they are bolted together as indicated above and thereafter further assembled with a truck and forks.

As an example of the packaging volume savings, if each weldment section of a lift arm is 5 inches thick, 10 inches wide and 60 inches long, then two sections stacked would be a volume of 10 inches by 10 inches by 60 inches for a total of 6,000 cubic inches required for a package size. Alternatively, if the lift arm is assembled such that the two weldment sections are approximately at right angles, the package volume required would be 60 inches by 60 inches by 5 inches, for a total package volume required of 18,000 cubic inches.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A refuse truck lift arm comprising:

a first joint plate having a inserted portion and an overlapping portion and said overlapping portion including a first pattern of bolt holes therethrough and a first key recess defined therein located within said first pattern of bolt holes;

a first weldment section comprised of two C-shape members, each C-shape member of the first weldment having a top flange and a bottom flange wherein the top and bottom flanges of the two C-shape members of the first weldment are welded together to form a tube shape, and wherein a portion of the top and bottom flanges of at least one of the C-shaped members of the first weldment are cut-out at one end to receive the inserted portion of the first joint plate, wherein the inserted portion of the first joint plate is welded to the top and bottom flanges of both of the C-shaped members of the first weldment;

a second joint plate having a inserted portion and an overlapping portion and the overlapping portion includes a second pattern of bolt holes therethrough and a second key recess defined therein located within the second pattern of bolt holes, wherein said second key recess is identical in size and shape to the first key recess;

a second weldment section comprised of two C-shape members, each C-shape member of the second weldment having a top flange and a bottom flange wherein the top and bottom flanges of the two C-shape members are welded together to form a tube shape, and wherein a portion of the top and bottom flanges of at least one of the C-shaped members of the second weldment are cut-out at one end to receive the inserted portion of the second joint plate, wherein the inserted portion of the second joint plate is welded to the top and bottom flanges of both of the C-shaped members of the second weldment;

a key having a size and shape complimentary to both said first and second key recesses;

wherein said overlapping portions of said first and second joint plates are complimentary;

wherein said first pattern of bolt holes and said second pattern of bolt holes align at a desired position;

wherein said first and second joint plates are coupled together by a plurality of fasteners and fixed in said desired position and said key is received into both said first and second key recesses when said first and second joint plates are coupled together in said desired position.

* * * * *